US008019043B2

(12) United States Patent
Horne et al.

(10) Patent No.: US 8,019,043 B2
(45) Date of Patent: Sep. 13, 2011

(54) HIGH-RESOLUTION X-RAY OPTIC AND METHOD FOR CONSTRUCTING AN X-RAY OPTIC

(75) Inventors: Stephen F. Horne, Chelmsford, MA (US); Michael J. Roderick, Everett, MA (US)

(73) Assignee: Energetiq Technology Inc., Woburn, MA (US)

( * ) Notice: Subject to any disclaimer, the term of this patent is extended or adjusted under 35 U.S.C. 154(b) by 15 days.

(21) Appl. No.: 12/505,012

(22) Filed: Jul. 17, 2009

(65) Prior Publication Data

US 2010/0014641 A1 Jan. 21, 2010

Related U.S. Application Data

(60) Provisional application No. 61/081,867, filed on Jul. 18, 2008.

(51) Int. Cl.
*G21K 1/06* (2006.01)

(52) U.S. Cl. ..... 378/85; 378/145

(58) Field of Classification Search ..... 378/85, 378/145, 84
See application file for complete search history.

(56) References Cited

U.S. PATENT DOCUMENTS 7,742,574 B2 * 6/2010 Karlsson ..... 378/145
2002/0148956 A1 * 10/2002 Piestrup et al. ..... 250/251

OTHER PUBLICATIONS

Attwood, D., "Soft X-rays and Extreme Ultraviolet Radiation: Principles and Applications," Cambridge University Press (2000), Chapters 1 and 3-4.

Artyukov, I.A., et al., "Advances in Short-Wavelength X-ray Multilayer Optics: Toward High-Throughput Multi-Mirror Systems for the Wavelengths < 10 nm," Proc. of SPIE, vol. 6702, 2007, pp. 67020V-1 thru 67020V-7.

Baez, A., et al., "Historical Description of Selected Experiments in the Early Development of X-ray Optics," SPIE, vol. 1546, 1991, pp. 472-488.

Barkusky, F., et al., "Compact EUV Source and Schwarzschild Objective for Modification and Ablation of Various Materials," Proc. of SPIE, vol. 6586, 2007, pp. 65860B-1 thru 65860B-12.

Bavdaz, M., et al., "X-ray Optics—new technologies at ESA," Proc. of SPIE, vol. 4851, 2003, pp. 421-432.

Bilderback, D.H., et al., "Monocapillary Optics Developments and Applications," International Centre for Diffraction Data 2003, Advances in X-ray Analysis, vol. 46, pp. 320-325.

Blackborow, Paul A., et al., "Application of the Energetiq EQ-10 Electrodeless Z-Pinch™ EUV Light Source in Outgassing and Exposure of EUV Photoresist," Emerging Lithographic Technologies XI, edited by Michael J. Lercel, Proc. of SPIE vol. 6517, pp. 65171W-1 thru 65171W-10 (2007).

Chon, Kwon Su, et. al., "Single-point Diamond Turning of Aspheric Mirror with Inner Reflecting Surfaces," Key Engineering Materials vols. 364-366 (2008) pp. 39-42.

(Continued)

*Primary Examiner* — Courtney Thomas
(74) *Attorney, Agent, or Firm* — Proskauer Rose LLP

(57) ABSTRACT

Described are optical apparatuses and methods for forming optical apparatuses. The optical apparatus includes a plurality of individually fabricated segments and a holder. Each of the plurality of individually fabricated segments include an inner annular surface and an outer contact surface opposite to the inner annular surface. Each of the inner annular reflecting surfaces define a longitudinal segment axis. The holder contacts each of the outer contact surfaces of the plurality of individually fabricated segments. Each of the longitudinal segment axes of the plurality of individually fabricated segments are linearly aligned.

21 Claims, 4 Drawing Sheets

OTHER PUBLICATIONS

Gubarev, M., et al., "Alignment System for Full-Shell Replicated X-Ray Mirrors," Proc. of SPIE, vol. 7360, 2009, pp. 73600A-1 thru 73600A-6.
Hoshino, M., et al., "Fabrication and Testing of Wolter type-I Mirrors for Soft X-ray Microscopes," Proc. of SPIE, vol. 5533, 2004, pp. 85-92.
Hudec, R., "History of Grazing Incidence X-ray Optics in the Czech Republic," Proc. SPIE, vol. 7360, 2009, pp. 73600D-1 thru 73600D-15.
Kim, Kyong-Woo, et al., "Compact soft x-ray transmission microscopy with sub-50nm spatial resolution," Phys. Med. Biol. 51, 2006, pp. N99-N107.
Meyer-Ilse, W., et al., "High resolution protein localization using soft X-ray microscopy," Journal of Microscopy, vol. 201, Pt 3, Mar. 2001, pp. 395-403.
Olynick, Deirdre L., et al., "25 nm mechanically buttressed high aspect ratio zone plates: Fabrication and performance," J. Vac. Sci. Technol. B 22(6), Nov./Dec. 2004, pp. 3186-3190.
Pina, L., et al., "Innovative X-ray Optics for Laboratory," Proc. of SPIE, vol. 4781, 2002, pp. 119-130.
Sayre, D., et al. "Potential Operating Region for Ultrasoft X-ray Microscopy of Biological Materials", Science, vol. 196, 1977, pp. 1339-1340.
Soong, Y., et al., "Recent advance in segmented thin-foil X-ray optics," Proceedings of SPIE vol. 4496, 2002, pp. 54-61.
Spiller, E., "Recent Advances in X-Ray Optics," Proc. of SPIE, vol. 5918, 2005, pp. 1-12.
Wells, C. M. M., et al., "Synchrotron-produced ultrasoft X-rays: a tool for testing biophysical models of radiation action," International Journal of Radiation Biology vol. 59, No. 4, 1991, pp. 985-996.
"EQ-10 Series EUV Source, EQ-10RH—Electrodeless Z-Pinch™ 10 Watt EUV Source," Energetiq Technology, Inc., Jun. 2006, 2 pages.
"EQ-10M Soft X-Ray & EUV Source—Electrodeless Z-Pinch™ 10 Watt EUV Source—Product Description" Aug. 2005, 2 pages.

* cited by examiner

130

140

300

HIGH-RESOLUTION X-RAY OPTIC AND METHOD FOR CONSTRUCTING AN X-RAY OPTIC

STATEMENT AS TO FEDERALLY SPONSORED RESEARCH

This invention was made with Government support under grants awarded by the National Institutes of Health (NIH) pursuant to Grant Nos. 1R43RR022488-01, 2R44RR022488-02, 5R44RR022488-03, and 2R44RR022488-04. The government may have certain rights in this invention.

FIELD OF THE INVENTION

The present invention relates generally to optical apparatuses and methods for forming optical apparatuses.

BACKGROUND OF THE INVENTION

There is no single, universally accepted definition of the range of photon energies which constitute X-rays. However, many skilled in this technology field use the following definitions: EUV (Extreme Ultraviolet) can cover the range of wavelengths from about 100 nm to about 10 nm; X-ray can cover the range of wavelengths from about 10 nm to about 0.01 nm. Soft X-rays, a subset of X-rays, can cover the range of wavelengths from about 10 nm to about 0.1 nm. There is a wide range of applications for radiation in the EUV and X-ray spectral ranges.

For wavelengths shorter than approximately 110 nm, there is a lack of viable materials which can be used to fabricate refractive optical elements for applications utilizing the EUV and X-ray spectral ranges. This is due to the fact that all materials absorb significantly at these wavelengths, particularly at thicknesses great enough to form a practical lens element. Therefore, reflective or diffractive optical elements are typically used for wavelengths of radiation shorter than approximately 110 nm. Such reflective elements can range from simple, planar mirrors to more complicated forms such as ellipses, parabolas, and combinations thereof. The ranges of wavelengths which require reflective optics therefore can include both the EUV range and the X-ray range.

As the wavelength of the radiation becomes shorter, the requirement on surface roughness for viable optical elements becomes correspondingly stricter as well. A complex relationship exists between the wavelength of the radiation, the angle of incidence of the radiation, the roughness of the reflective surface and the corresponding reflectivity of the incident radiation off of the surface. This can be seen from the results of sample numerical calculations, as shown in FIGS. 1A-1D, which are two-dimensional plots 110-140 illustrating reflectivity versus photon energy for copper surfaces of varying roughness and for different incident angles. The plot 110 illustrates reflectivity versus photon energy for an incident photon angle of 1 degree and surface roughness of 1 nm. The plot 120 illustrates reflectivity versus photon energy for an incident photon angle of 1 degree and surface roughness of 10 nm. The plot 130 illustrates reflectivity versus photon energy for an incident photon angle of 5 degree and surface roughness of 1 nm. The plot 140 illustrates reflectivity versus photon energy for an incident photon angle of 5 degree and surface roughness of 10 nm. As FIGS. 1A-1D illustrate, for high reflectivity it is necessary to have an appropriate combination of shallow angle of incidence and low surface roughness (low relative to the wavelength being reflected).

A surface can be brought to a very low roughness level through the use of machining techniques and/or polishing. Diamond-turning, which can involve the use of a specialized lathe combined with cutting tools utilizing a diamond cutting edge, can provide surface roughness as low as 1 nm. However, this can be achieved only in limited circumstances, having to do with the material and geometry of the part being fabricated. Polishing can also be employed to provide a desirable final surface roughness. However, the ability to effectively polish a surface is also dependent on the geometry of that surface. As a general rule, surfaces that are concave with a high degree of curvature are typically more difficult to fabricate to a very low roughness value than those which are flat to convex and have a low degree of curvature.

Synchrotrons can provide one flexible source of radiation in both the EUV and X-ray spectral ranges. Synchrotrons are typically part of a large, relatively expensive facility, usually supported by a governmental agency. The radiation from a synchrotron beamline typically is emitted in a very bright, narrow beam. Therefore, focusing optics, such as zone plates described below, can be effectively used as both collection and imaging elements over the EUV and soft X-ray ranges. Applications utilizing synchrotron radiation in the EUV and X-ray spectral ranges and zone plates for focusing can include soft X-ray biological microscopes and EUV exposure studies for semiconductor lithography applications.

One source of EUV and X-ray radiation that can be used as an alternative to synchrotrons are plasma based sources. Plasma-based sources can use either a high power pulsed laser system to generate the high temperature plasma required to generate these wavelengths, or they can use a pulsed electrical discharge. As an example, Energetiq Technology, Inc. of Woburn, Mass., offers for sale an EUV and soft X-ray source based on the use of a z-pinch technology that inductively couples pulsed dc energy into a discharge region, such that the required high temperature discharge can be attained to generate both EUV and soft X-ray radiation. As an example of the size of a discharge produced plasma (DPP) source, the z-pinch source from Energetiq Technology can produce an EUV and X-ray emitting spot that is approximately 0.4 to 1.0 mm in diameter.

When a DPP radiation source is used in place of a synchrotron radiation source, use of the condenser zone plate becomes less favorable. Useful zone plate throughput is limited theoretically to <20% for light incident within the small acceptance numerical aperture (typically less than 0.02 in the soft X-ray region). In a synchrotron-based system, enough power is available that a 90% (or more) loss of throughput may be acceptable. However, a DPP radiation source appropriate to a small laboratory will have limited output power and such losses would be unacceptable. Therefore a higher throughput condenser lens element is desirable when a DPP radiation source is used. There can also be instances where a higher throughput condenser lens element would be desirable for a synchrotron or other type of source as well.

An additional feature of the DPP radiation source (as compared to a laser plasma source) is that the size of the X-ray emitting region is relatively large. This allows use of a demagnifying optic which concentrates the larger source size, providing higher illumination intensity while still allowing an adequate illuminated field of view. In addition, the larger source size relaxes the mechanical alignment and positioning constraints on the condensing optic.

One class of optical elements that can be used as an alternative to a condenser zone plate consists of grazing incidence reflective devices. These are reflective elements configured such that the angle of incidence of the light to be focused is small—typically only a few degrees or less. By keeping the incidence angle small and the surface roughness very low, the throughput of grazing incidence devices can be quite large—in excess of 50%, and approaching 100% for some configurations.

Grazing incidence devices can be used in many possible configurations (e.g., Wolter, de-magnifying or magnifying ellipse, tandem ellipse (unity magnification), capillaries). Grazing incidence devices can achieve high throughput (>50%), and are robust and rugged due to their macroscopic size. However, it can be difficult to machine small, high aspect ratio grazing incidence devices.

Zone plates can use a non-uniform, circular transmission grating to diffract radiation. Transmission efficiency (throughput) of zone plates are approximately 20% or less. In addition, zone plates are microscopic, fragile and expensive to fabricate, and require very specialized manufacturing facilities. Furthermore, zone plates can suffer from severe chromatic aberration, while reflective optical elements are generally achromatic.

SUMMARY OF THE INVENTION

One approach to providing an optical apparatus is to construct the optic from a plurality of segments. In one aspect, there is an optical apparatus. The optical apparatus includes a plurality of individually fabricated segments and a holder. Each of the plurality of individually fabricated segments includes an inner annular surface and an outer contact surface opposite to the inner annular surface. Each of the inner annular reflecting surfaces define a longitudinal segment axis. The holder contacts each of the outer contact surfaces of the plurality of individually fabricated segments. Each of the longitudinal segment axes of the plurality of individually fabricated segments are linearly aligned.

In another aspect, there is a method for manufacturing an optical apparatus. The method includes providing a plurality of individually fabricated segments and a holder. Each of the plurality of individually fabricated segments include an inner annular surface and an outer contact surface opposite to the inner annular surface. Each of the inner annular reflecting surfaces define a longitudinal segment axis. The method also includes positioning each of the individually fabricated segments in the holder by having the holder contact the outer contact surfaces. Each of the longitudinal segment axes of the plurality of individually fabricated segments are linearly aligned by the outer contact surfaces contacting the holder.

In other examples, any of the aspects above can include one or more of the following features. The optical apparatus can be an X-ray grazing incident apparatus. The optical apparatus can be an EUV or soft X-ray grazing incidence apparatus. The inner annular surfaces of the plurality of individually fabricated segments can include an internal reflecting surface that defines a radiation channel. The radiation channel can be aligned along the linearly aligned longitudinal segment axes. The radiation channel can be ellipsoidal or at least substantially ellipsoidal in shape. One or more inner annular surfaces of the plurality of individually fabricated segments can be conical in shape. The individually fabricated segments can include machined segments, electroformed segments, polished segments, or any combination thereof. The individually fabricated segments can include nickel, nickel-copper alloy, copper plated with nickel, aluminum plated with nickel, or any combination thereof. The method can further include machining, electroforming, and/or polishing one or more segments to form one or more of the individually fabricated segments.

Any of the above implementations can realize one or more of the following advantages. An optical element formed from individual segments can advantageously provide superior optical performance than that which could be obtained through fabrication of the X-ray optic element as a single mechanical element, because the segmented design can allow for greater design freedom than a single monolithic structure would allow. In addition, the length of a segment can be made small enough such that short machining tools can advantageously be used, thereby avoiding thin, long machining tools that tend to vibrate or distort causing unacceptable surface roughness and/or figure error.

The details of one or more examples are set forth in the accompanying drawings and the description below. Further features, aspects, and advantages of the invention will become apparent from the description, the drawings, and the claims. The drawings are not necessarily to scale, emphasis instead generally being placed upon illustrating the principles of the invention.

BRIEF DESCRIPTION OF THE DRAWINGS

The foregoing and other objects, features, and advantages of the present invention, as well as the invention itself, will be more fully understood from the following description of various embodiments, when read together with the accompanying drawings.

DESCRIPTION OF THE INVENTION

Figure 1A:
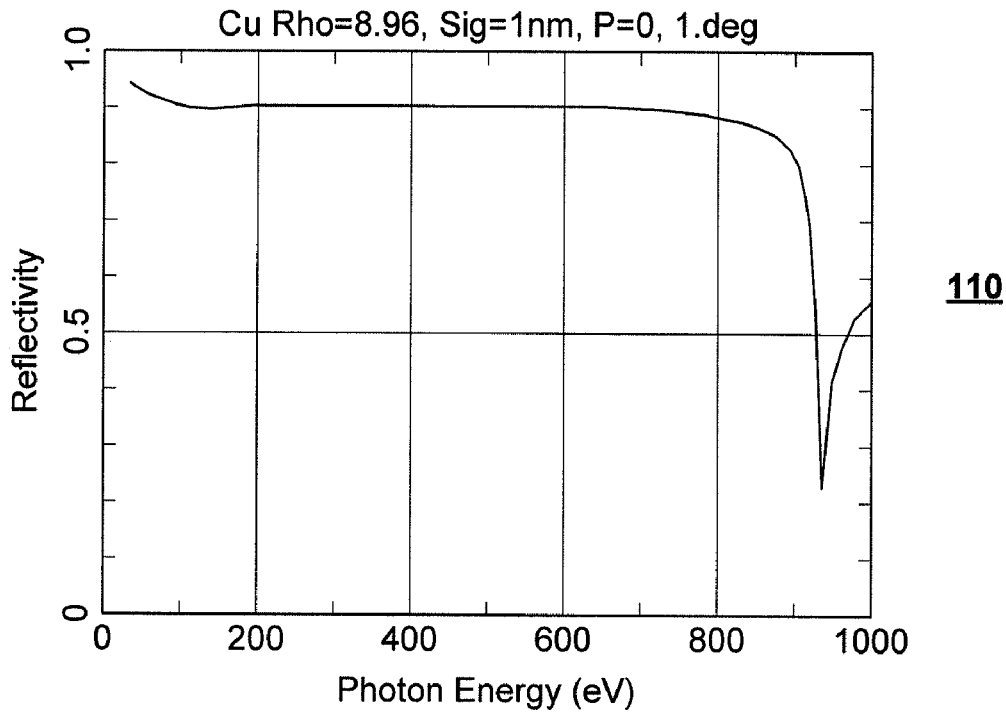
FIGS. 1A-1D are two-dimensional plots illustrating reflectivity versus photon energy for copper surfaces of varying roughness and for different incident angles.
Figure 1B:
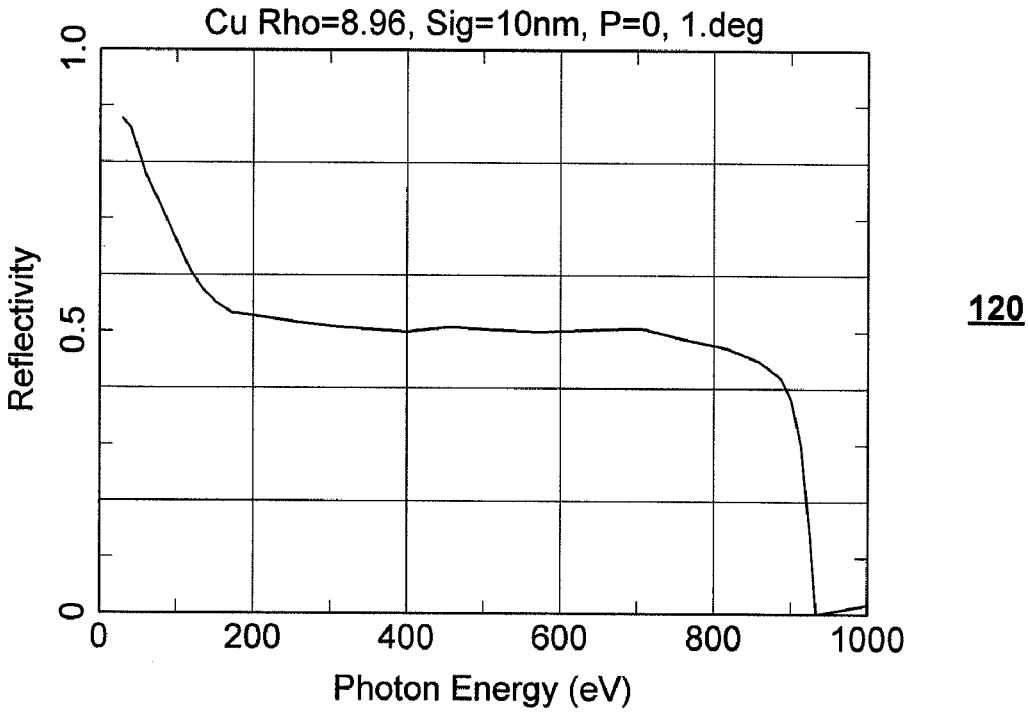
Figure 1C:
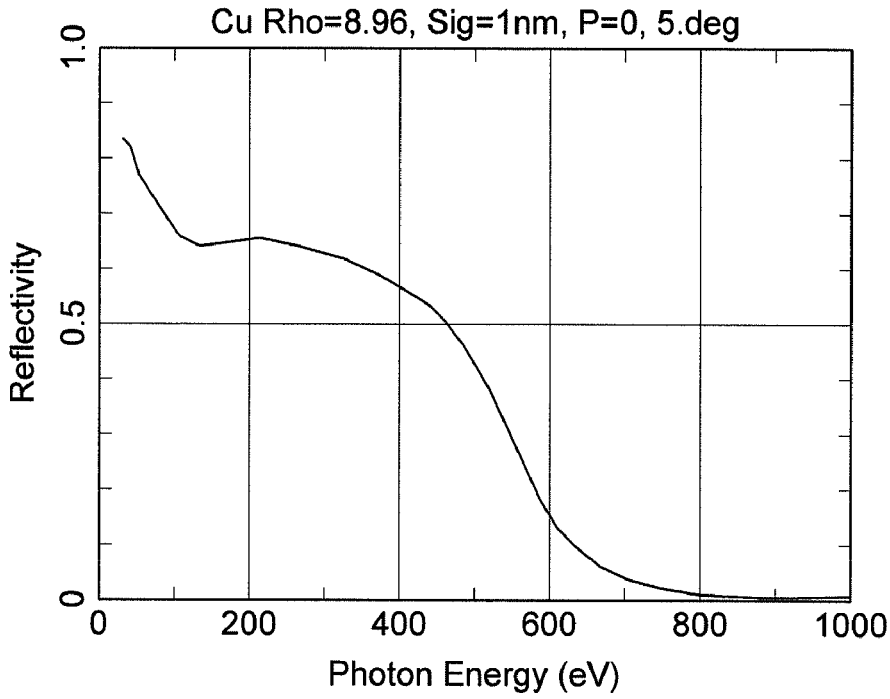
Figure 1D:
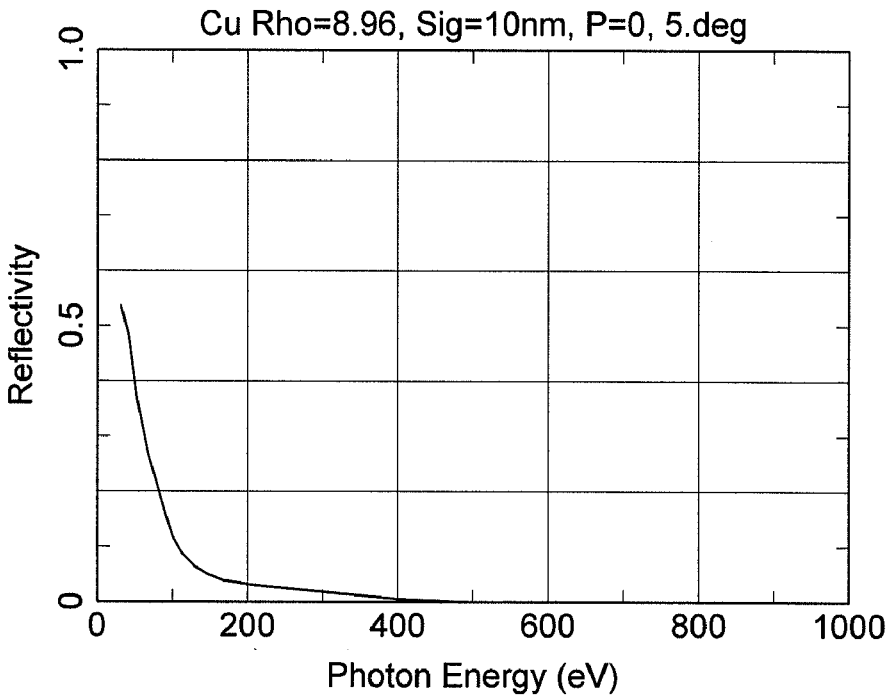

The invention relates to a high-resolution optical element that can be formed from multiple segments, each of which is independently fabricated by techniques such as machining, electroforming and polishing. Optical elements can include EUV optical elements, X-ray optical elements, and/or optical elements directed to any arbitrary spectral range. The individual segments can be assembled into a single, functional optic element by mechanically aligning them on a precision holder. An optical element formed from individual segments can advantageously provide superior optical performance than that which could be obtained through fabrication of the X-ray optic element as a single mechanical element, because the segmented design can allow for greater design freedom than a single monolithic structure would allow.

In one embodiment, the invention features a configuration by which a high aspect ratio grazing incidence optic element can be manufactured, while using conventional diamond-turning machining techniques. Constructing the optic element out of a single monolithic mechanical element can require machining small, precise, low-surface roughness features having a high aspect-ratio. This can either be very difficult or impossible to achieve using state-of-the-art diamond machining techniques. Instead, in the subject invention, an optic element can be constructed from multiple, separate segments that are independently machined and mounted together in a precision assembly to form a single optical element.

For example, in a cylindrical geometry, the inner surface can be turned to form a section of a concave ellipse, and the outer cylindrical surface can be used to register the segment against a precision mount. An ellipsoid can have the property that all rays emanating from one focus are returned, after a single reflection from an inner ellipsoidal surface, to a second focus. In some embodiments, the inner reflective surface of each segment can be machined to a specific ellipsoidal form such that when two or more segments are assembled, a continuous ellipsoidal focusing element can be obtained. The precision with which the axis of the inner reflecting surface and that of the outer surface coincide can define the optical alignment of multiple segments.

In some embodiments, the inner reflective surfaces of the individually fabricated segments can be conical in shape. Conical shapes can advantageously allow for more efficient and/or effective polishing of the surface. Any desired shape for the inner surface of the optical element can advantageously be approximated as a series of conical segments. For example, if the desired shape for the inner surface is an ellipsoid, then conical segments can be formed where the average slope of the conical segments is made to approximate the slope of the desired ellipsoid. The accuracy of the approximation can be increased by decreasing the width of the segments. In general, one or more segments can be machined such that the inner surface forms shapes ranging from simple, planar mirrors to more complicated forms of ellipses, parabolas, other geometric shapes, or any combinations thereof.

Figure 2A:
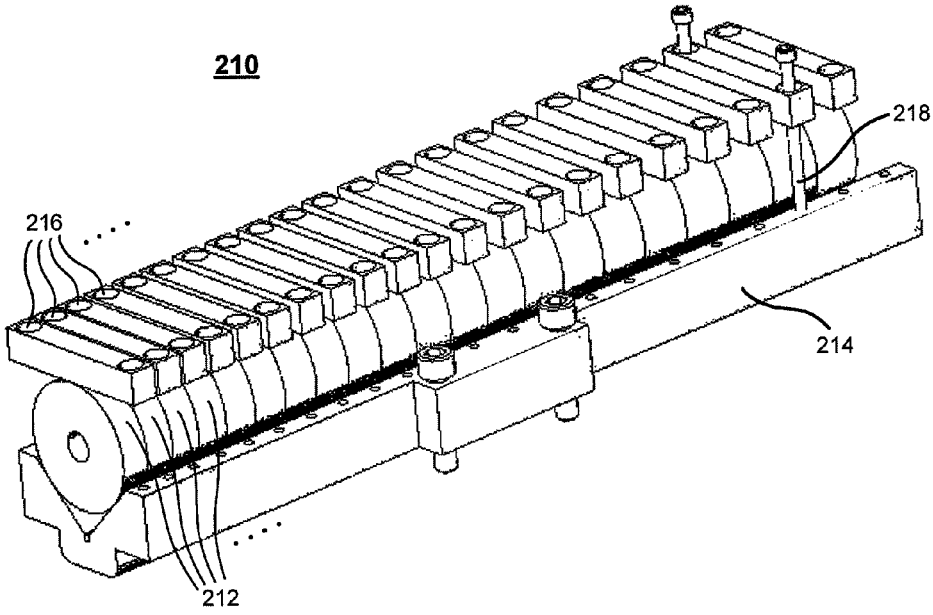
FIGS. 2A-2B show diagrams of an optic element.

FIG. 2A shows a diagram of one embodiment of an optic element 210. The optic element 210 can include two or more separately machined segments 212 and a V-block 214, which can be used to precisely mount the individual segments 212. One or more clamps 216 can be used to secure one or more segments 212 to the V-block 214 using screws 218. The length of each of the individual segments 212 can be chosen so that the internal reflecting surface can be machined and/or polished to a desired level of surface roughness. The length of a segment 212 can be made small enough such that short machining tools can advantageously be used, thereby avoiding thin, long machining tools that tend to vibrate or distort causing unacceptable surface roughness and/or figure error. In some embodiments, the length of one or more segments 212 can be between 2 and 30 mm.

The material of construction of each of the segments 212 can be one of a number of elements and/or alloys that are stable, resistant to corrosion, and/or able to be machined and/or polished to a low level of surface roughness. Materials of construction can include, for example, nickel, nickel-copper alloy, copper plated with nickel or another protective coating, aluminum plated with nickel or other coating, or any combination of such materials, that can be machined and/or polished adequately.

Figure 2B:
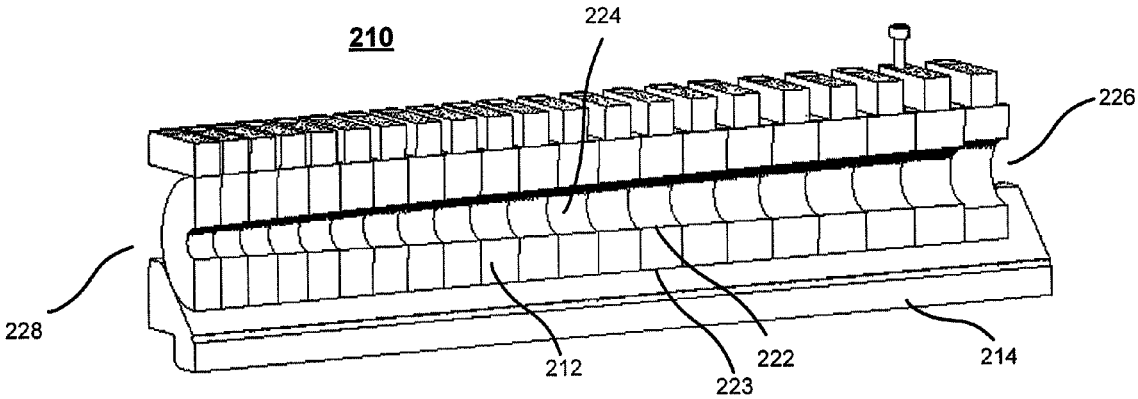

FIG. 2B shows a cross-sectional diagram of the optic element 210. Each segment 212 includes an inner annular surface 222 and an outer contact surface 223, which can be opposite to the inner annular surface 222. The inner annular surface 222 for a particular segment 212 can define a longitudinal axis for that segment. By positioning the segments 212 in the V-block 214, the segments 212 can be aligned such that each of their longitudinal segment axes are linearly aligned with each other. Taken together, each of the inner annular surfaces 222 can define an internal reflecting surface that defines a radiation channel 224. Radiation can enter the channel 224 via opening 226 of the channel 224 and exit via opening 228 of the channel 224. The required surface roughness of the reflecting surface 222 can depend on both the wavelength of radiation and the maximum grazing angle. In some embodiments, the surface roughness of the individual machined segments 212 can be about 4 nm. Surface roughness can be measured, for example, using an interferometric technique. Surface roughness can be improved upon with further refinement to the machining process, and can also be improved upon by adding polishing steps and/or coating steps to the manufacturing process.

In some embodiments, the inner diameter of the radiation channel 224 can range from about 1 mm to about 30 mm. In alternative or supplemental embodiments, the thickness of the walls of the segments 212 can range from 0.5 mm to about 40 mm.

Figure 3:
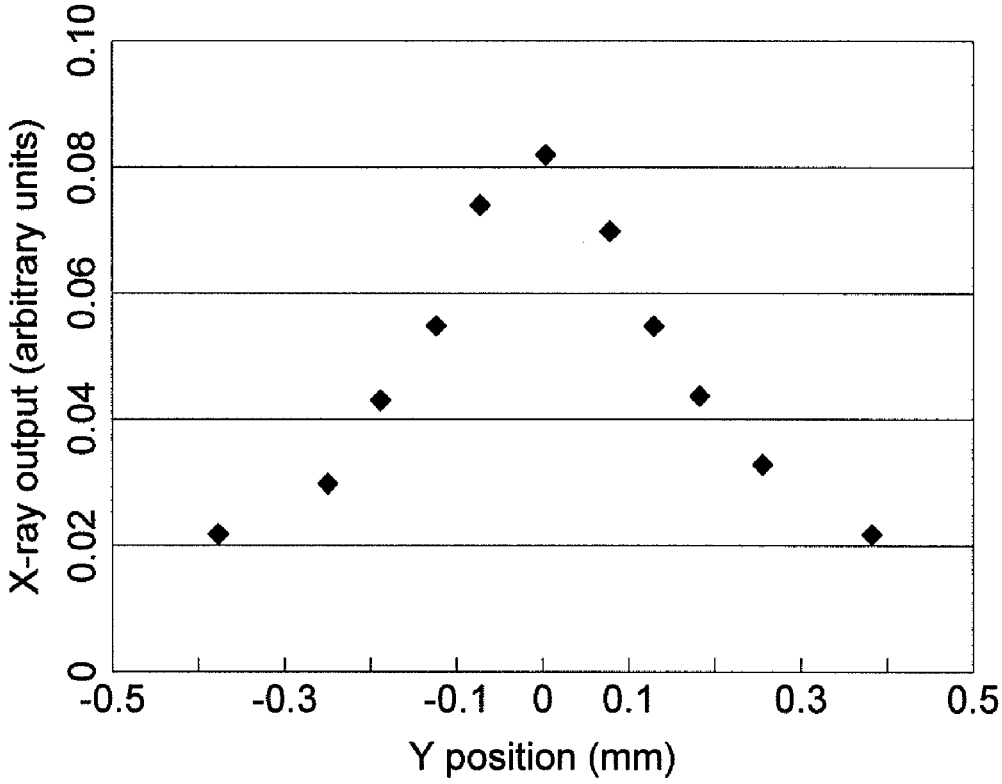
FIG. 3 shows a two-dimensional plot of the measured optical output from a segmented condenser optic, at its focal point, versus position.

FIG. 3 shows a two-dimensional plot 300 of the measured optical output from a segmented condenser optic, at its focal point, versus radial position. The results in FIG. 3 are consistent with predictions via numerical modeling of a monolithic condenser optic.

In a supplemental or alternative embodiment, a grazing incidence elliptical optic can be made by diamond machining a mandrel, and then electroforming an elliptical reflector onto it. The mandrel can be machined in shorter segments, and then the individual segments can be electroformed separately, and later joined together in a precision mechanical assembly.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed:

1. An optical apparatus comprising:

a plurality of individually fabricated segments each comprising an inner annular reflecting surface and an outer contact surface opposite to the inner annular reflecting surface, each of the inner annular reflecting surfaces defining a longitudinal segment axis; and a holder contacting each of the outer contact surfaces of the plurality of individually fabricated segments, wherein each of the longitudinal segment axes of the plurality of individually fabricated segments are linearly aligned.

2. The optical apparatus of claim 1 wherein the optical apparatus comprises an X-ray grazing incident apparatus.

3. The optical apparatus of claim 1 wherein the optical apparatus comprises an EUV or soft X-ray grazing incident apparatus.

4. The optical apparatus of claim 1 wherein the inner annular reflecting surfaces of the plurality of individually fabricated segments comprise an internal reflecting surface that defines a radiation channel.

5. The optical apparatus of claim 4 wherein the radiation channel is aligned along the linearly aligned longitudinal segment axes.

6. The optical apparatus of claim 4 wherein one or more inner annular reflecting surfaces of the plurality of individually fabricated segments are conical in shape.

7. The optical apparatus of claim 4 wherein the radiation channel is substantially ellipsoidal in shape.

8. The optical apparatus of claim 1 wherein the individually fabricated segments comprise machined segments, electroformed segments, polished segments, or any combination thereof.

9. The optical apparatus of claim 1 wherein the individually fabricated segments comprise nickel, nickel-copper alloy, copper plated with nickel, aluminum plated with nickel, or any combination thereof.

10. A method of manufacturing an optical apparatus, the method comprising:

providing a plurality of individually fabricated segments each comprising an inner annular reflecting surface and an outer contact surface opposite to the inner annular reflecting surface, each of the inner annular reflecting surfaces defining a longitudinal segment axis;

providing a holder; and positioning each of the individually fabricated segments in the holder by having the holder contact the outer contact surfaces, wherein each of the longitudinal segment axes of the plurality of individually fabricated segments are linearly aligned.

11. The method of claim 10 wherein the optical apparatus comprises an X-ray grazing incident apparatus.

12. The method of claim 10 wherein the optical apparatus comprises an EUV grazing incident apparatus.

13. The method of claim 10 wherein the inner annular reflecting surfaces of the plurality of individually fabricated segments comprise an internal reflecting surface that defines a radiation channel.

14. The method of claim 13 wherein the radiation channel is aligned along the linearly aligned longitudinal segment axes.

15. The method of claim 13 wherein one or more inner annular reflecting surfaces of the plurality of individually fabricated segments are conical in shape.

16. The method of claim 15 wherein the radiation channel is substantially ellipsoidal in shape.

17. The method of claim 10 further comprising machining one or more segments to form one or more of the individually fabricated segments.

18. The method of claim 10 further comprising electroforming one or more segments to form one or more of the individually fabricated segments.

19. The method of claim 10 further comprising polishing one or more segments to form one or more of the individually fabricated segments.

20. The method of claim 10 wherein the individually fabricated segments comprise nickel, nickel-copper alloy, copper plated with nickel, aluminum plated with nickel, or any combination thereof.

21. An optical apparatus comprising:

a plurality of individually fabricated segments each comprising a means for reflecting radiation, each of the means for reflecting radiation defining a longitudinal segment axis; and a holder means for linearly aligning each of the longitudinal segment axes of the plurality of individually fabricated segments; each of the plurality of individually fabricated segments further including means for contacting the holder.

* * * * *